US007735189B2

(12) United States Patent
Richardson

(10) Patent No.: US 7,735,189 B2
(45) Date of Patent: Jun. 15, 2010

(54) HANGER DEVICE WITH DECORATIVE COVERS

(76) Inventor: Margaret A. Richardson, 11734 Willshire Blvd., #C1310, Los Angeles, CA (US) 90025-3750

( * ) Notice: Subject to any disclaimer, the term of this patent is extended or adjusted under 35 U.S.C. 154(b) by 932 days.

(21) Appl. No.: 11/446,032

(22) Filed: Jun. 3, 2006

(65) Prior Publication Data

US 2007/0277355 A1 Dec. 6, 2007

(51) Int. Cl.
*E05D 15/00* (2006.01)

(52) U.S. Cl. ..... 16/87.2; 24/716

(58) Field of Classification Search ..... 16/87.2, 16/87 R; 24/716; 160/330, 404; D8/367, D8/368

See application file for complete search history.

(56) References Cited

U.S. PATENT DOCUMENTS 1,528,111 A * 3/1925 Jensch ..... 24/360
1,979,674 A * 11/1934 Cowan ..... 160/387
3,322,182 A * 5/1967 Gloria ..... 160/344
3,766,572 A 10/1973 Wright
4,010,503 A 3/1977 Denton
D253,276 S 10/1979 Levine
4,237,561 A 12/1980 Britton
4,308,637 A 1/1982 Kucera
4,333,187 A 6/1982 Schuler
D268,005 S 2/1983 Levine
4,385,409 A 5/1983 File et al.
D272,129 S 1/1984 Levine
4,538,727 A 9/1985 Solloway
4,693,291 A 9/1987 Andrews
4,718,962 A 1/1988 Goodwin
4,750,243 A 6/1988 Davis
4,955,422 A 9/1990 Irizarry
4,979,712 A 12/1990 Rios
5,007,120 A 4/1991 Annand
5,097,541 A 3/1992 Annand
5,154,218 A 10/1992 Subcez
5,170,974 A 12/1992 Ruggiero
5,191,922 A 3/1993 Wade
5,216,766 A 6/1993 Lang
5,228,149 A 7/1993 Phinn, Jr.
5,259,520 A 11/1993 Roggio et al.
D344,670 S 3/1994 Kearns
5,339,884 A 8/1994 Angerman
5,355,551 A 10/1994 Schechter et al.

(Continued)

FOREIGN PATENT DOCUMENTS

DE 29916670 U1 1/2000

(Continued)

*Primary Examiner*—William L. Miller

(57) ABSTRACT

The invention is directed to a hanger device used to suspend hanging materials such as curtains, shower curtains, or other sheet-like materials from a horizontally suspended rod to provide a barrier or for decorative purposes. In a preferred embodiment, the hanger device comprises a body portion having first and second ends; an extending member connected to and extending from each of the first and second ends; and, a fixed or removable decorative element having a connector portion and a cover portion for attaching to one or both extending members, wherein when a plurality of hanging materials are suspended from the hanger device, a top portion of the hanging materials is coupled to each opposed extending member, such that the hanging materials are positioned between the decorative elements and the body portion.

15 Claims, 10 Drawing Sheets

U.S. PATENT DOCUMENTS

| | | | | |
|---|---|---|---|---|
| 5,367,742 | A | 11/1994 | Bindman | |
| 5,426,821 | A | 6/1995 | Story | |
| 5,428,867 | A | 7/1995 | Hannerstig | |
| 5,499,725 | A | 3/1996 | Palumbo | |
| 5,586,375 | A * | 12/1996 | Cooperman et al. | 24/716 |
| 5,651,407 | A | 7/1997 | Perez | |
| 5,787,954 | A | 8/1998 | Herrera | |
| 5,806,141 | A | 9/1998 | Kolisch | |
| 5,894,642 | A | 4/1999 | Eberhardt | |
| 6,038,749 | A | 3/2000 | Eberhardt | |
| 6,047,441 | A | 4/2000 | Moorman | |
| D436,024 | S | 1/2001 | Freedland | |
| 6,189,597 | B1 | 2/2001 | Cheng | |
| 6,192,965 | B1 | 2/2001 | Hinds | |
| D439,141 | S | 3/2001 | Ho | |
| D439,142 | S | 3/2001 | McGrath, Jr. | |
| D441,584 | S | 5/2001 | Ho | |
| D456,696 | S | 5/2002 | Samelson | |
| D457,807 | S | 5/2002 | Vanderbilt | |
| 6,394,168 | B1 | 5/2002 | Zaboski | |
| D458,536 | S | 6/2002 | Samelson | |
| D459,201 | S | 6/2002 | Michaelson | |
| D464,867 | S | 10/2002 | Samelson | |
| 6,484,788 | B1 | 11/2002 | Jerrell et al. | |
| 6,494,248 | B1 | 12/2002 | Zahner | |
| 6,505,380 | B1 | 1/2003 | Bourgeois | |
| 6,530,120 | B2 | 3/2003 | Samelson | |
| D484,027 | S | 12/2003 | Clucas | |
| 6,698,061 | B2 | 3/2004 | Ho | |
| D489,249 | S | 5/2004 | Moore | |
| 6,789,279 | B2 | 9/2004 | Yarid | |
| 6,845,525 | B2 | 1/2005 | Bathurst | |
| D505,315 | S | 5/2005 | Snell | |
| D505,614 | S | 5/2005 | Barrese | |
| 6,931,694 | B2 | 8/2005 | Chen | |
| 7,320,419 | B1 * | 1/2008 | Finamore | 223/85 |
| 2002/0108724 | A1 | 8/2002 | Grahn | |
| 2003/0028998 | A1 | 2/2003 | Samelson | |
| 2003/0046757 | A1 | 3/2003 | Yarid | |
| 2003/0131405 | A1 | 7/2003 | Greaves | |
| 2003/0172502 | A1 * | 9/2003 | Ho | 24/716 |
| 2004/0034921 | A1 | 2/2004 | Yarid | |
| 2004/0128754 | A1 | 7/2004 | Bathurst | |
| 2005/0028330 | A1 | 2/2005 | Hsu | |
| 2005/0278844 | A1 | 12/2005 | Boyd, Jr. | |
| 2005/0286886 | A1 | 12/2005 | Koziak | |
| 2006/0026747 | A1 | 2/2006 | Prabhakar | |
| 2007/0261330 | A1 * | 11/2007 | Liu | 52/235 |

FOREIGN PATENT DOCUMENTS

| | | | |
|---|---|---|---|
| GB | 2272152 | A | 5/1994 |
| GB | 2382770 | A | 6/2003 |
| GB | 2407036 | A | 4/2005 |
| WO | WO 2004/023598 | A2 | 3/2004 |

* cited by examiner

HANGER DEVICE WITH DECORATIVE COVERS

The subject matter described herein is directed to a hanger device used to suspend hanging materials, such as shower curtains, drapery, or other sheet-like materials, from a horizontally suspended rod to provide a barrier or for decorative purposes. More particularly, the invention is directed to a unique, novel, and nonobvious hanger device with decorative covers used on a single elongated rod member to suspend one or more hanging materials from two independent extending members which can be viewed from two opposing sides.

BACKGROUND OF THE INVENTION

Hanger devices for hanging shower curtains, drapery and other hanging materials are known. Such known hanger devices include curtain rings, single hooks and double hooks. Curtain rings are often difficult to engage and disengage from the curtains and the rod, they are manufactured in limited design styles, and they often only provide a single curtain engaging member from which it is difficult to hang, access, remove and/or replace two or more curtains or hanging materials. Single hooks require a user to remove the hook from the rod each time a curtain is removed or replaced, the user is potentially required to remove and replace both curtains when accessing a single curtain, and the curtains often slip off of the hook when the hooks are moved horizontally across the rod. Double hooks generally do not have fixed or removable decorative covers and do not have two positive and opposing front views. In addition, while most curtain rod assemblies are adequately functional, unsightly metallic or plastic rods often detract from maintaining a decorative appearance. Replacing an existing rod may not be permitted such as in rental apartments or may be difficult, costly, and require skilled labor, such as drilling in tile, backer board, and hard to reach places. Rod covers exist in the prior art but the covers often hinder the movement of the rings along the rod and are often costly and time consuming to install.

Accordingly, there is a need for a new and improved hanger device with decorative covers that does not have the problems associated with known hanger devices.

SUMMARY OF THE INVENTION

The invention satisfies the need for a new and improved hanger device with decorative covers. None of the known hanger devices provide all of the numerous advantages of the invention. Unlike known hanger devices, the hanger device with decorative covers of the invention provides the following advantages: it is simple and economical to manufacture, use and maintain; it is durable and provides a long service life; it is easily attached to and removed from an elongated support or curtain rod; it connects to one significantly fixed object; it has two positive and opposing front views; it has two extending members to independently suspend or hang separate hanging materials; it can suspend one, two or more hanging materials at one time; it provides the use of interchangeable decorative elements; in one version it conceals an elongated support rod; it is decorative and manufactured in appealingly styled design; it provides numerous decorative alternatives; it can be used to suspend hanging materials for the purpose of dividing a living space into two separate rooms or areas, dividing a bathroom space into two separate areas, partitioning off a dressing room in a retail store or other venue, and creating a privacy curtain or divider on boats, buses, trains, planes, and other modes of transportation; it can be used in conjunction with shower or bathtub curtains and liners; it prevents the overspray of water outside of the bathtub or shower stall onto the bathroom floor; and it separates hanging materials which facilitates greater airflow and reduces the chance of moisture and mildew formation. Thus, it is the object of the invention to provide a new device which has many of the advantages of prior art devices and many novel features which result in a new device that is not anticipated, rendered obvious, suggested, or even implied by any of the prior art devices, either alone or in any combination.

In one version of the invention, a hanger device adapted to be mounted over an elongated rod member and adapted to suspend a plurality of hanging materials is provided, wherein the hanger device comprises: a body portion having a generally circular configuration with an inside diameter sufficient in size for encircling a portion of the rod member when the hanger is coupled to the rod member and the rod member is suspended in a horizontal position, the body portion having a first end, a second end, and a top central portion; an extending member connected to and extending from each of the first and second ends of the body portion, wherein each extending member has an outer portion with an opening, and further wherein each extending member is opposite the other extending member and extends away from the other extending member; and, a decorative element having a connector portion with a top end and a bottom end and having a cover portion with an inner surface and an outer surface, wherein the bottom end of the connector portion is adapted for insertion into the opening of the extending member, such that the decorative element is releasably secured to one or both of the extending members, and wherein the top end of the connector portion is attached to the inner surface of the cover portion, and further wherein when the plurality of hanging materials are suspended from the hanger device, a top portion of the hanging materials is coupled to each opposed extending member. The decorative element of this version may be removably attached or fixed to the extending member.

In another version of the invention, a hanger device adapted to be mounted over an elongated rod member and adapted to suspend a hanging material is provided, wherein the hanger device comprises: a body portion having a generally semi-circular configuration with an inside diameter sufficient in size for semi-encircling a portion of the rod member when the hanger is coupled to the rod member and the rod member is suspended in a horizontal position, the body portion having a first end, a second end, and a top portion; an extending member connected to and extending from the first end of the body portion, wherein the extending member has an outer portion with an opening; and, a decorative element having a connector portion with a top end and a bottom end and having a cover portion with an inner surface and an outer surface, wherein the bottom end of the connector portion is adapted for insertion into the opening of the extending member, such that the decorative element is releasably secured to the extending member, and wherein the top end of the connector portion is attached to the inner surface of the cover portion, and further wherein when the hanging material is suspended from the hanger device, a top portion of the hanging material is coupled to the extending member so that the hanging material is positioned between the decorative element and the body portion. The decorative element of this version may be removably attached or fixed to the extending member.

These and other features and advantages of the invention will become better understood from the following description and appended claims and accompanying drawings.

BRIEF DESCRIPTION OF THE DRAWINGS

Exemplary embodiments or versions of the invention are shown in the drawings, in which.

DETAILED DESCRIPTION OF THE INVENTION

The invention is directed to a unique, novel, and nonobvious hanger device with decorative covers used to suspend one or more hanging materials, such as drapes, shower curtains, or other sheet-like materials from a horizontally suspended rod to provide a barrier or for decorative purposes. The invention relates to a hanger device used on a single elongated rod member to suspend one or more hanging materials from two independent extending members which can be viewed from two opposing sides.

Figure 1:
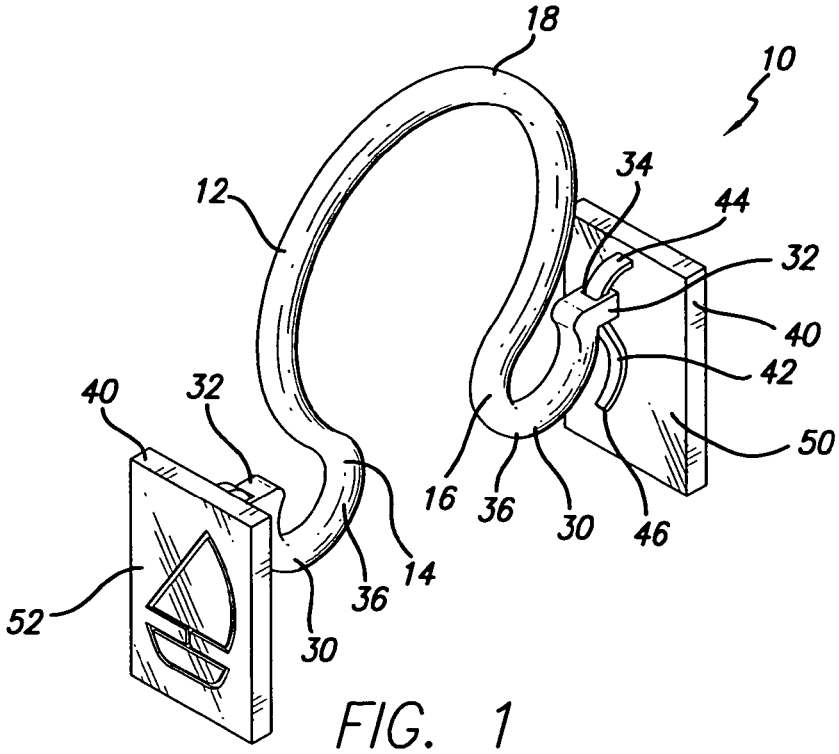
FIG. 1 is a perspective view of a first version of the hanger device of the invention.
Figure 9:
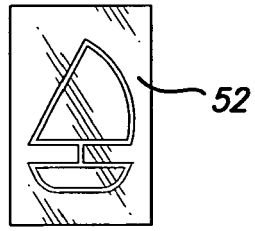
FIG. 9 is a front view of the decorative element of the hanger device of FIG. 1.
Figure 10:
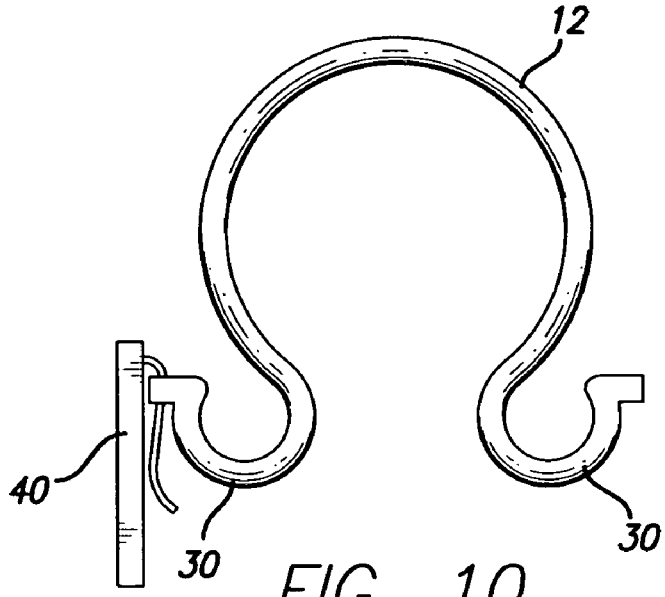
FIG. 10 is a front view of another version of the hanger device of the invention having only one decorative element.
Figure 11:
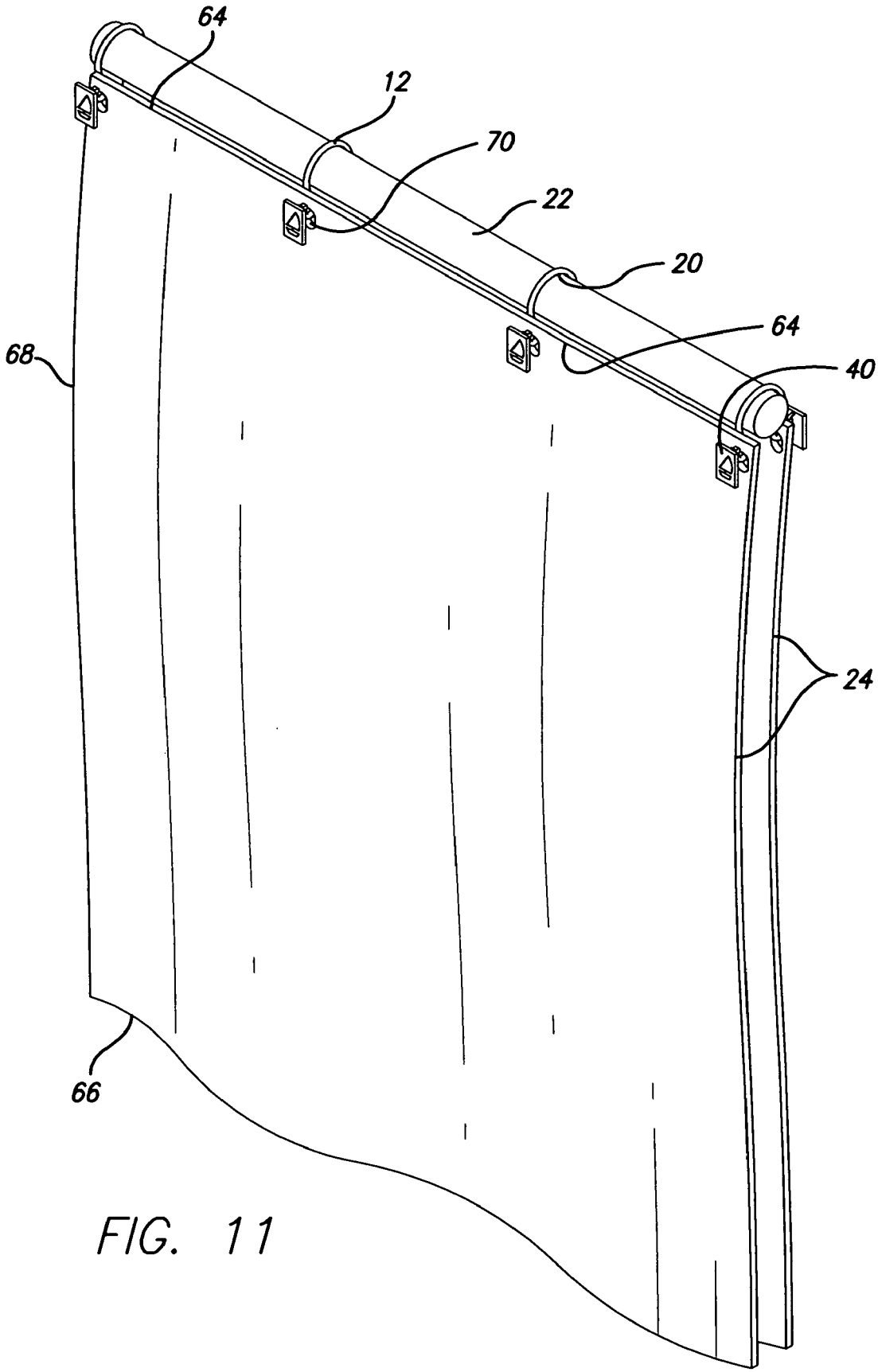
FIG. 11 is perspective view of a plurality of hanger devices as shown in FIG. 1 that are suspending hanging materials.
Figure 16:
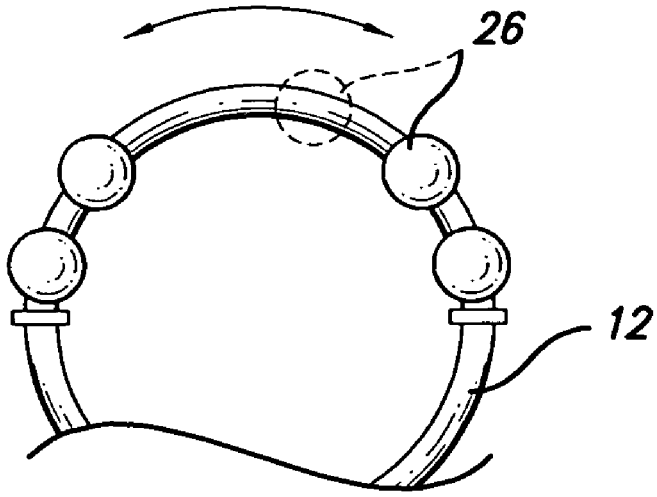
FIG. 16 is a front view of the body portion of the hanger device of the invention having movable ball bearings.
Figure 17:
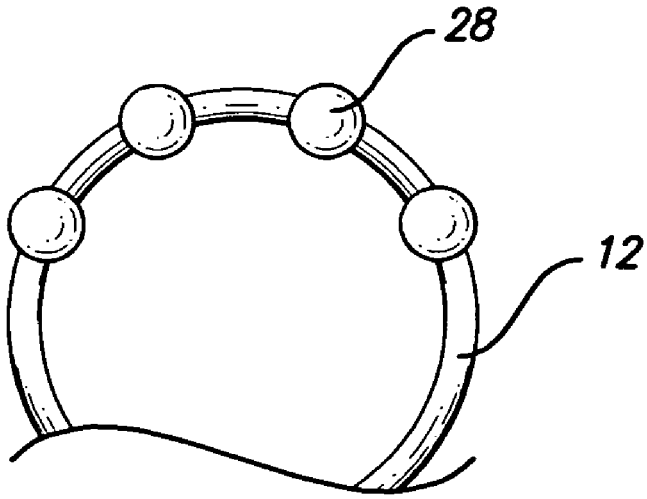
FIG. 17 is a front view of the body portion of the hanger device of the invention having fixed ball bearings.

With reference now to the drawings, a first version or embodiment of the hanger device of the invention is shown in FIGS. 1-11. FIG. 1 is a perspective view of a first version of a hanger device 10 of the invention. The hanger device 10 comprises a body portion 12 having a first end 14, a second end 16, and a top central portion 18. The body portion 12 preferably has a generally circular configuration with an inside diameter that is of a sufficient size for encircling a portion 20 of an elongated rod member 22 when the hanger device 10 is coupled to the rod member and the rod member is suspended in a horizontal position, as shown in FIG. 11. FIG. 11 is perspective view of a plurality of hanger devices 10 that are suspending a plurality of hanging materials 24 such as curtains. The body portion may be in the configuration of a complete circle, a semi-circle, an incomplete circle, or another suitable geometric shape. The body portion is configured and dimensioned to extend cooperatively around an elongated rod member. Mounting of the hanger device on a rod is accomplished by applying minimal force to the base of the hanger to widen its generally circular shaped opening, enabling the hanger device to attach or couple onto the rod. Once in place on the rod, the body portion of the hanger device then regains its original shape. As shown in FIGS. 16-17, the body portion of any of the versions of the hanger device of the invention may include a plurality of movable ball bearings or beads 26 (FIG. 16) or fixed ball bearings or beads 28 (FIG. 17) coupled to the body portion. Preferably, each of the ball bearings or beads has a central hole through which the body portion of the hanger device is inserted or the ball bearings may be embedded in recesses within the inner diameter of the body portion. The ball bearings facilitate the movement of the body portion of the hanger device along an elongated rod. The movable ball bearings or beads may also be used as a counter weight mechanism for balancing imbalanced hanging materials. Preferably, the ball bearings are made of stainless steel, metal, plastic, silicone, rubber, nylon, or another suitable material.

As shown in FIG. 1, the hanger device 10 further comprises an extending member 30 connected to and extending from each of the first and second ends 14, 16 of the body portion 12. Each extending member 30 has an outer portion 32 with an opening 34 and an inner portion 36. Preferably, each extending member 30 is opposite the other extending member and extends away from the other extending member. Thus, the extending members are preferably opposed extending members. When the hanger device is coupled to a rod, the extending members are biased away from each other and extend transversely from the central body portion. Preferably, the configuration of the extending members may be in the form of hooks, clamps, clips, snaps, or another suitable configuration that will function to suspend and retain one or more hanging materials from the hanger device. As shown in FIG. 1, the extending member 30 is in the form of a curved hook shape. The extending member is configured and dimensioned to extend through an aperture in a hanging material, such as a curtain, for suspending the hanging material vertically from a horizontally positioned rod. The hanging material or materials may also be suspended from loops, ties, tabs or other such means provided for suspending the materials. The hanging material is retained by the extending member on the hanger device.

The body portion 12 is preferably of a unitary, continuous configuration. The opposed extending members 30 may or may not be of a unitary, continuous configuration with the body portion 12. The body portion and extending member are preferably formed of an elastomeric material, such as vinyl or rubber. However, the body portion and extending member may also be formed of any natural or man-made material, such as a substantially rigid material or a flexible plastic, metal, wood, or another suitable material. Preferably, the hanger device, and in particular, the body portion of the hanger device, is formed of an elastomeric material to allow the deformation of the hanger to a distance greater than the diameter of the rod member and to have a resilience to regain its original generally circular configuration. Preferably, the hanger device is formed of a material having a tensile strength greater than the tear strength of the hanging materials.

As shown in FIGS. 1 and 7-9, the hanger device 10 further comprises a decorative element 40 having a connector portion 42 with a top end 44 and a bottom end 46 and having a cover portion 48 with an inner surface 50 and an outer surface 52. The bottom end 46 of the connector element is adapted for insertion into the opening 34 of the extending member 30, such that the decorative element 40 may be releasably secured to the extending member 30. The top end 44 of the connector portion is attached to the inner surface 50 of the cover portion 48. The extending member 30 on each of the first and second ends 14, 16 is designed to receive and hold the decorative element 40. In the version of the invention shown in FIG. 1, in a first embodiment or version, the decorative element 40 may be releasably attached or removable from the extending member, and in a second embodiment or version, the decorative element 40 may be permanently fixed to the extending member. The connector portion may be in the form of a hook, snap, clip, screw, clamp, hook and loop, twist lock, hinge, latch, or other suitable connector type element. The cover portion 48 includes inner surface 50 or mounting side which is attached to the connector element. The purpose of the connector element is to releasably affix or permanently affix the decorative element to the extending member. The cover portion 48 includes outer surface 52 which is preferably decorative in design. With a releasable or removable decorative element, this offers a user the opportunity to change the decorative elements whenever a decorative change is desired. In another version of the invention, the cover element further includes a removable front surface (not shown) such that the front surface is capable of having a plurality of interchangeable decorative shapes.

Figure 7:
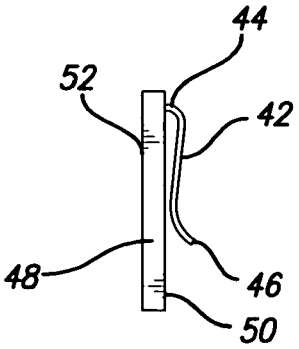
FIG. 7 is a right side view of the decorative element of the hanger device of FIG. 1.
Figure 8:
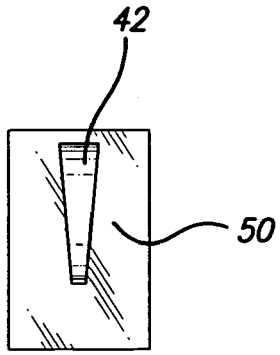
FIG. 8 is a back view of the decorative element of the hanger device of FIG. 1.
Figure 18A:
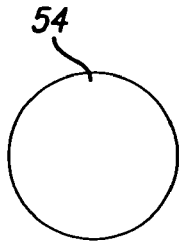
FIG. 18A is a front view of a second version of a decorative element of the invention.
Figure 18B:
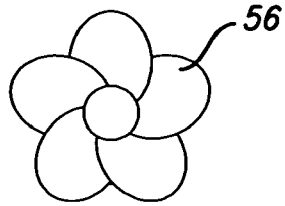
FIG. 18B is a front view of a third version of a decorative element of the invention.
Figure 18C:
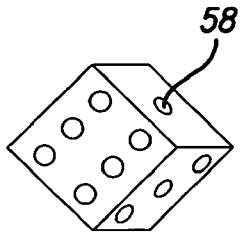
FIG. 18C is a front view of a fourth version of a decorative element of the invention.
Figure 18D:
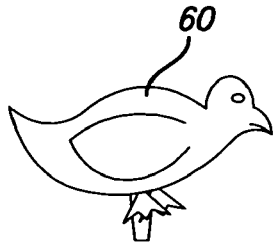
FIG. 18D is a front view of a fifth version of a decorative element of the invention.
Figure 19A:
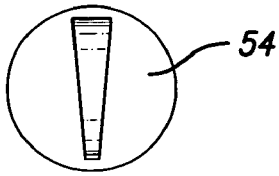
FIG. 19A is a back view of the decorative element of FIG. 18A.
Figure 19B:
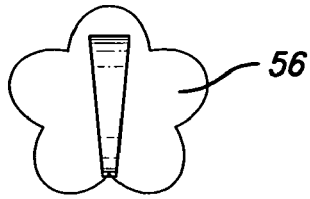
FIG. 19B is a back view of the decorative element of FIG. 18B.
Figure 19C:
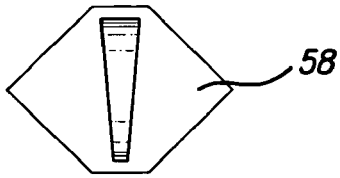
FIG. 19C is a back view of the decorative element of FIG. 18C.
Figure 19D:
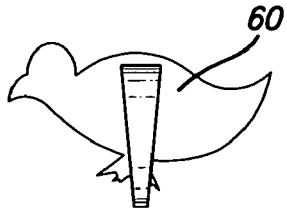
FIG. 19D is a back view of the decorative element of FIG. 18D.

The decorative element may be constructed of any natural or man-made materials, such as glass, cloth, wood, ribbon, shells, beads, metal, plastic, resin, rubber, acrylic, polyester, paint, or another suitable material. The decorative element may be constructed in various colors, shapes, sizes, materials, and designs. The decorative cover portion may be designed to coordinate with the hanging material and environment of each respective space where it is used. FIG. 7 is a right side view of the decorative element of the hanger device of FIG. 1. FIG. 8 is a back view of the decorative element of the hanger device of FIG. 1. FIG. 9 is a front view of the decorative element of the hanger device of FIG. 1. Additional decorative elements are shown in FIGS. 18A-19D. FIG. 18A is a front view of a second version of a decorative element 54 in the form of a circle. FIG. 19A is a back view of the decorative element of FIG. 18A. FIG. 18B is a front view of a third version of a decorative element 56 in the form of a flower. FIG. 19B is a back view of the decorative element of FIG. 18B. FIG. 18C is a front view of a fourth version of a decorative element 58 in the form of a dice. FIG. 19C is a back view of the decorative element of FIG. 18C. FIG. 18D is a front view of a fifth version of a decorative element 60 in the form of a bird. FIG. 19D is a back view of the decorative element of FIG. 18D.

The decorative element is simple to manufacture and easy to assemble and attach to the extending member, and no special tools are needed to safely and efficiently attach the decorative element to the extending member. The connector portion and cover portion are configured so that the decorative element will not wobble when it rests on and is coupled to the extending member. In the preferred embodiment, the hanger device includes two decorative elements, one coupled to each extending member extending from the first and second ends of the body portion. However, only one decorative element may also be used if desired, and such decorative element may be coupled to either one of the extending members extending from the first and second ends of the body portion.

Figure 2:
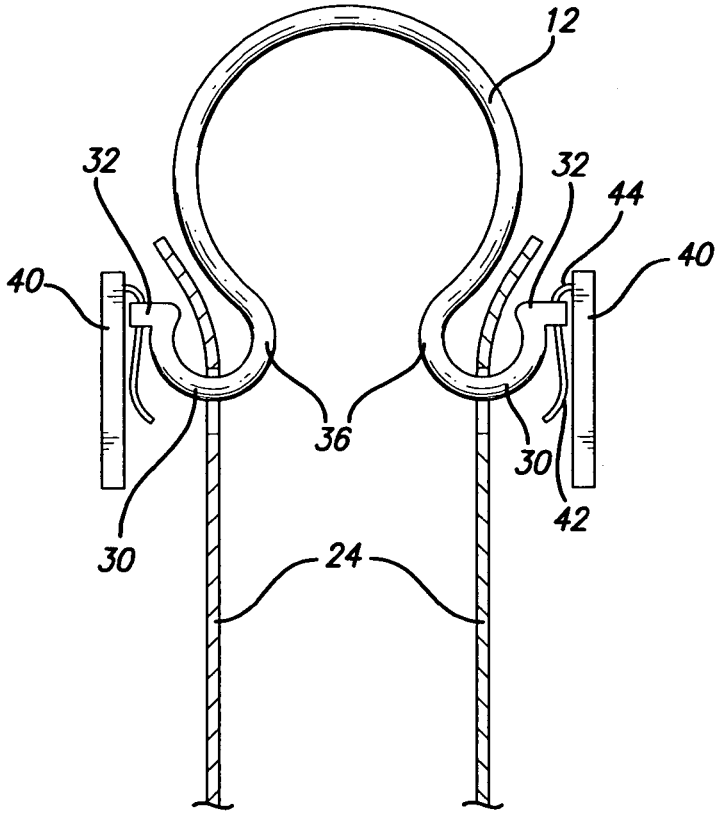
FIG. 2 is a front view of the hanger device of FIG. 1 with hanging materials suspended vertically by the device.

In the first version of the invention as shown in FIG. 2, when the plurality of hanging materials are suspended from the hanger device, a top portion 62 of the hanging materials 24 may be coupled onto each opposed extending member 30, and the decorative element may be releasably secured to one extending member, or decorative elements may be releasably secured to both of the opposed extending members. The fixed decorative element may be small enough and of a suitable size to be inserted through an aperture of the hanging material. In an alternative, the fixed decorative element may be any size if used with hanging materials having tabs, loops, or non-apertured hanging means. In another alternative, the hanger device may have one fixed decorative element of any size and another opposite fixed decorative element that may be small enough and of a suitable size to be inserted through an aperture of the hanging material, so that the hanging material may be removed and replaced from the small end.

In the first version of the invention, as shown in FIG. 11, each extending member 30 extends below the top central portion 18 of the body portion, such that when the hanging materials 24 are suspended from the hanger device 10, a top portion 62 of each top end 64 of the hanging materials is positioned below the horizontally suspended rod member 22. The hanger device of this version is designed to suspend the top end of the two hanging materials below the single rod, thereby exposing the rod. The top portion of the hanging materials is preferably positioned between or intermediate the decorative element and the body portion of the hanger device. This version of the invention is directed to a hanger device used on a single rod to suspend two hanging materials from two independent extending members or platforms which may be positively viewed from two opposing sides.

Preferably, the hanging material or materials used with the hanger device of the invention may comprise drapery, shower curtains, curtains, blankets, towels, tapestries, artwork, room dividers, frames, mirrors, garments, or other suitable hanging or sheet-like materials. Preferably, the hanging material 24 is generally rectangular, flexible, and planar in shape with a relatively small thickness. The thickness of the hanging material is preferably such that the hanging material can easily be suspended and secured from the hanger device or devices of the invention. As shown in FIG. 11, the hanging material 24 has a top end 64, a bottom end 66, sides 68, and a plurality of apertures 70 spaced along the top end in a row. Preferably, the hanging material is generally commensurate in length with the horizontally suspended rod 22. The extending member of the hanger device is adapted for insertion through the aperture of the hanging material, such that the hanging material is securely suspended from the hanger device. However, the hanging material or materials may also be suspended from loops, ties, tabs or other such means provided for suspending the materials. Preferably, the hanging material is fabricated of cloth, plastic, rubber, vinyl, wood or another suitable material. In use, the hanger device is adapted to be mounted over the elongated rod member 22 and adapted to suspend a hanging material or a plurality of hanging materials 24. The hanger device is configured and dimensioned to extend cooperatively around the rod 22 and through an aperture 60 in the hanging material 24 for suspending the hanging material 24 from the rod 22.

Figure 3:
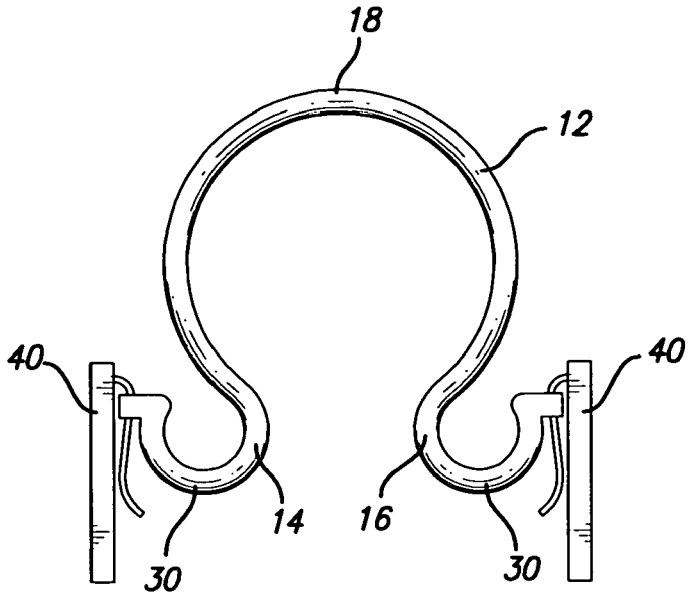
FIG. 3 is a front view of the hanger device of FIG. 1.
Figure 4:
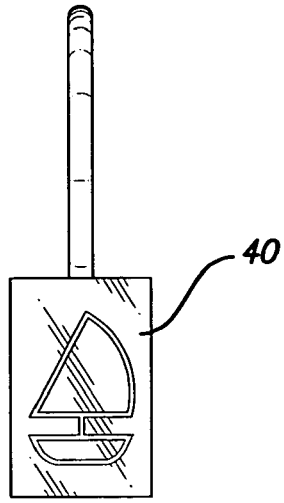
FIG. 4 is a left side view of the hanger device of FIG. 1.
Figure 5:
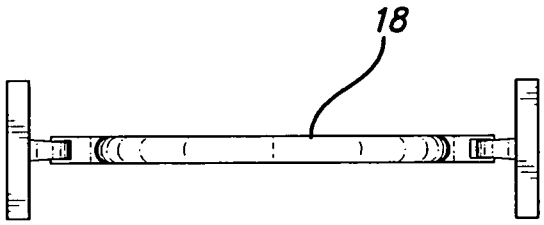
FIG. 5 is a top view of the hanger device of FIG. 1.
Figure 6:
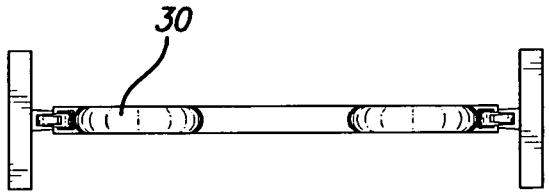
FIG. 6 is a bottom view of the hanger device of FIG. 1.

FIG. 2 is a front view of the hanger device of FIG. 1 with hanging materials suspended vertically by the device. FIG. 3 is a front view of the hanger device of FIG. 1. FIG. 4 is a left side view of the hanger device of FIG. 1. FIG. 5 is a top view of the hanger device of FIG. 1. FIG. 6 is a bottom view of the hanger device of FIG. 1. FIG. 10 is a front view of another version of the hanger device of the invention having only one decorative element.

Figure 12:
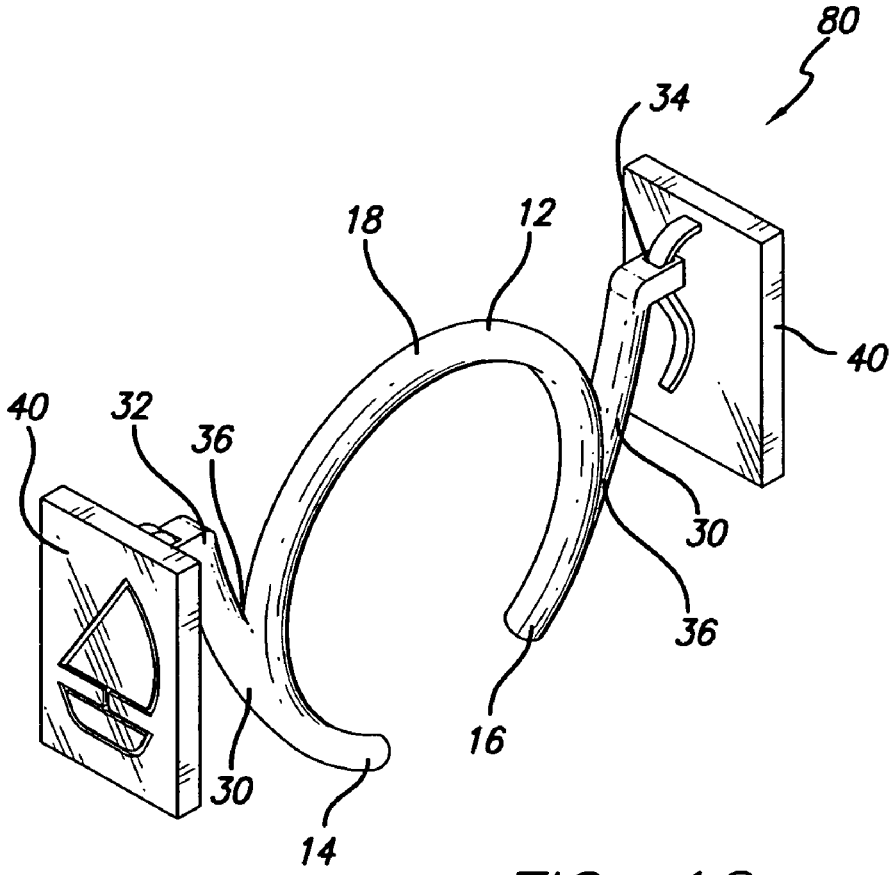
FIG. 12 is a perspective view of a second version of the hanger device of the invention.
Figure 13:
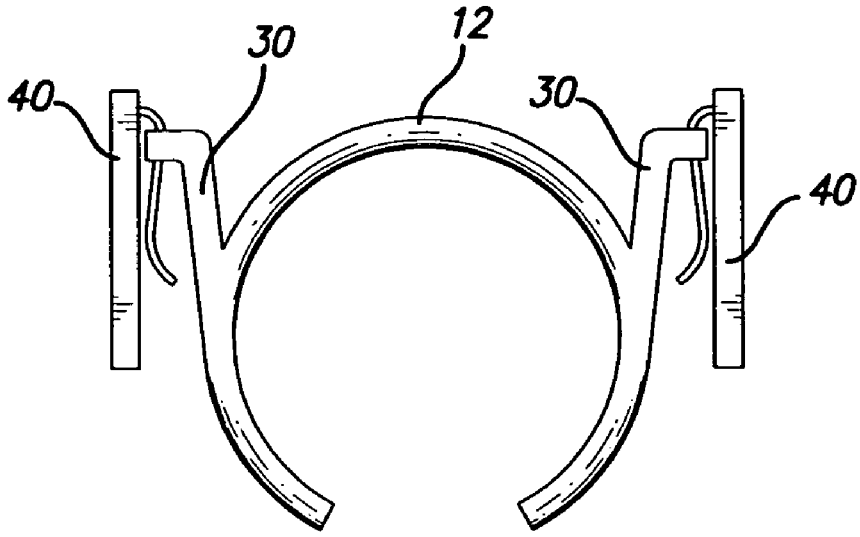
FIG. 13 is a front view of the hanger device of FIG. 12.
Figure 14:
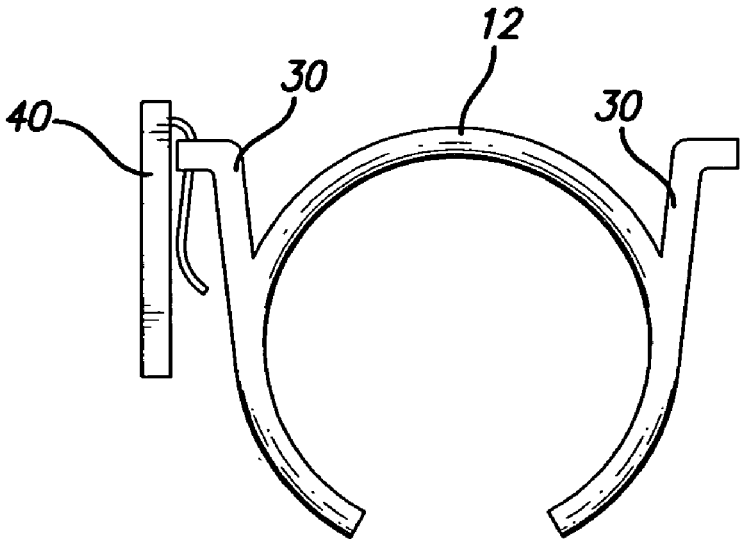
FIG. 14 is a front view of the hanger device of FIG. 12 with only one decorative element.
Figure 15:
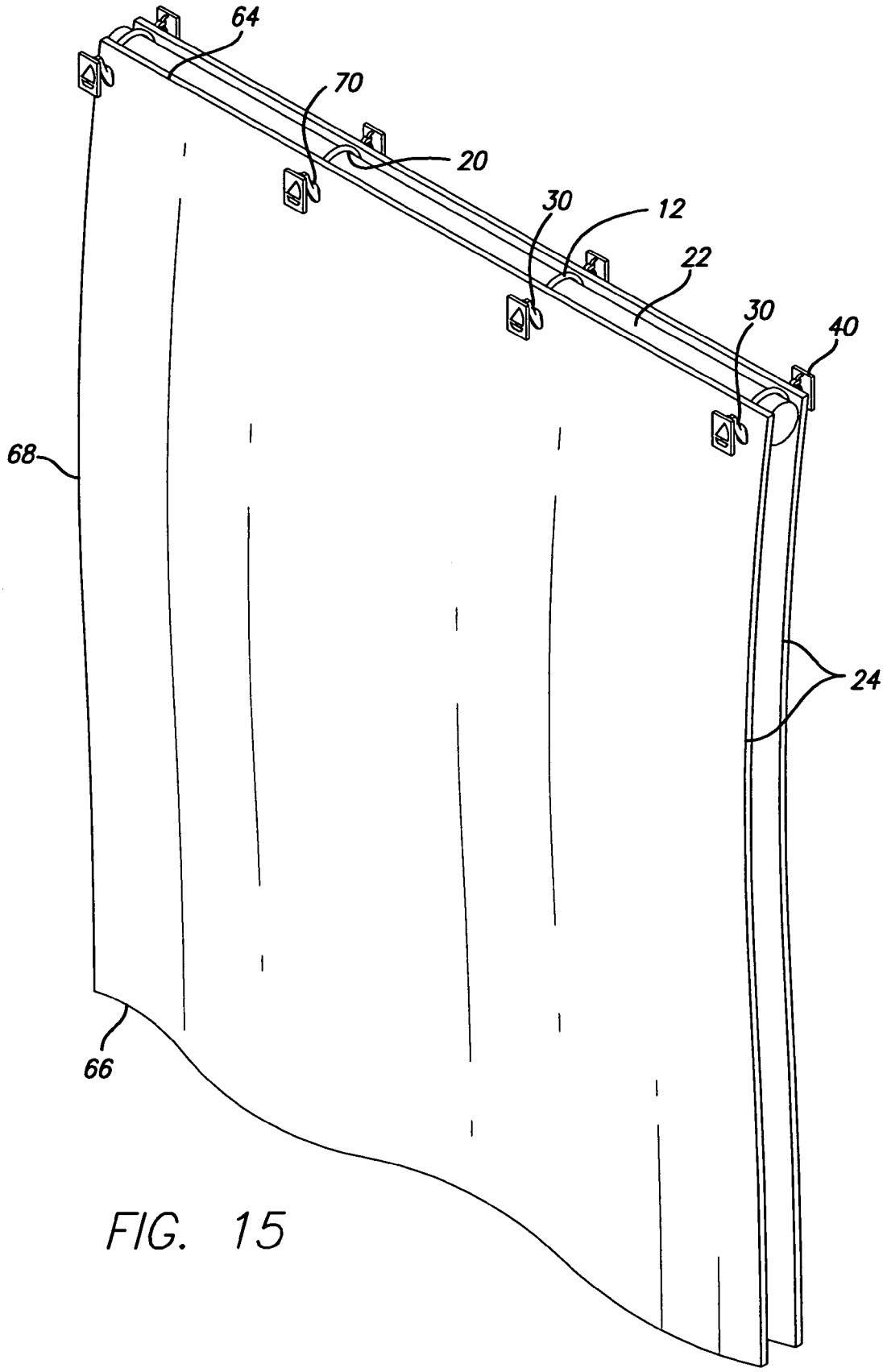
FIG. 15 is a perspective view of a plurality of hanger devices as shown in FIG. 12 that are suspending hanging materials.

A second version of the invention is shown in FIGS. 12-15. FIG. 12 is a perspective view of a second version of a hanger device 80 of the invention. FIG. 13 is a front view of the hanger device of FIG. 12. FIG. 14 is a front view of the hanger device of FIG. 12 with only one decorative element. FIG. 15 is a perspective view of a plurality of hanger devices as shown in FIG. 12 that are suspending hanging materials. The hanger device of this version includes all of the elements of the first version as discussed in detail above, that is, the body portion 12 having first end 14, second end 16 and top central portion 18, the extending member 30 extending from each of the first and second ends such that one extending member is opposite the other extending member, and the decorative element 40 releasably attached or fixed to one or both of the opposed extending members. However, in this version, as shown in FIG. 13, each extending member 30 extends upwardly at an angle (rather than curved) above or at substantially the same level or plane as the top central portion 18 of the body portion 12, such that when the hanging materials 24 are suspended from the hanger device 10, the top end 64 of each of the hanging materials 24 is positioned above the horizontally suspended rod member 22. The hanger device in this version is designed to suspend the top end of the two hanging materials at or above the level of the single rod, thereby concealing the rod. The top portion of the hanging materials is preferably positioned between or intermediate the decorative element and the body portion of the hanger device. This hanger device version is designed to conceal the support rod when the hanging material is fully extended and suspended vertically downwardly from the support rod, and provides greater level of privacy such as beneath stairways or basement windows, blocks a greater amount of light, and offers decoration alternatives such as enabling a curtain to be suspended or hung at ceiling height.

Figure 20:
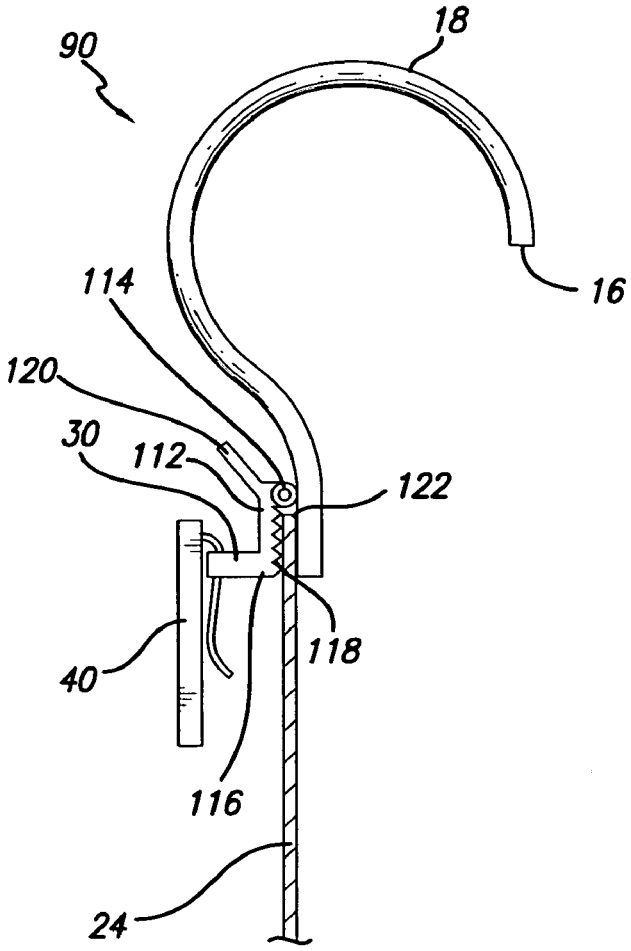
FIG. 20 is a front view of a third version of the hanger device of the invention.

The invention also contemplates additional versions of the invention. FIG. 20 is a front view of a third version of the hanger device of the invention. In this version, a hanger device 90 adapted to be mounted over an elongated rod member and adapted to suspend a hanging material is provided. The hanger device 90 comprises body portion 12 having a generally semi-circular configuration with an inside diameter sufficient in size for semi-encircling a portion of the rod member when the hanger is coupled to the rod member and the rod member is suspended in a horizontal position. The body portion 12 comprises first end 14, second end 16, and top central portion 18. The hanger device 90 further comprises a single extending member 30 having inner portion 36 connected to and extending from the first end 14 of the body portion 12, and further having outer portion 32 with an opening 34. The second end 16 of the body portion is a free end. The extending member 30 is in the form a clamp member 112 having a hinge portion 114, a gripping surface 116 with teeth 118 and a handle portion 120. The hanger device 90 further comprises decorative element 40 having connector portion 42 with top end 44 and bottom end 46 and having cover portion 48 with inner surface 50 and outer surface 52, wherein the bottom end of the connector portion is adapted for insertion into the opening of the extending member such that the decorative element may be releasably secured to the extending member. The top end of the connector portion is attached to the inner surface of the cover portion. When hanging material 24 is suspended from the hanger device 90, top portion 62 of the hanging material is coupled to the extending member 30 by clamping the top portion of the hanging material between the gripping surface 116 with teeth 118 and against an exterior surface 122 of the body portion, and the decorative element 40 is releasably secured to the extending member. In this version, the top portion of the hanging material is preferably positioned between the body portion and the decorative element.

Figure 21:
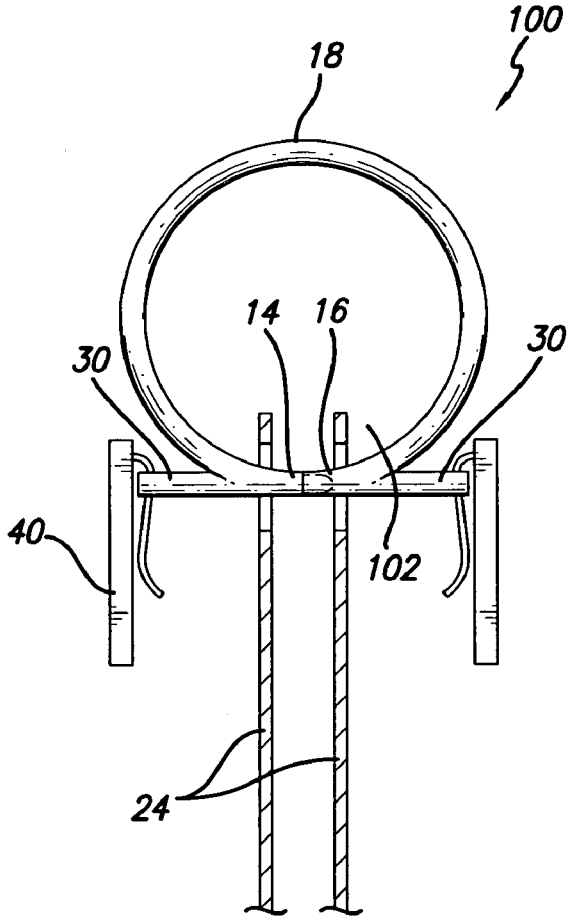
FIG. 21 is a front view of a fourth version of the hanger device of the invention.

FIG. 21 is a front view of a fourth version of the hanger device of the invention. In this version, a hanger device 100 comprises a body portion 12 having a full circular configuration with an inside diameter sufficient in size for completely encircling a portion of the rod member when the hanger is coupled to the rod member and the rod member is suspended in a horizontal position. The hanger device of this version includes all of the elements of the first version as discussed in detail above, that is, the body portion 12 having first end 14, second end 16 and top central portion 18, the extending member 30 extending from each of the first and second ends such that one extending member is opposite the other extending member, and the decorative element 40 releasably attached or fixed to one or both of the opposed extending members. However, in this version, as shown in FIG. 21, each extending member 30 extends horizontally outwardly in a substantially straight line rather than angled or curved upwardly. When hanging material 24 is suspended from the hanger device 100, top portion 62 of the hanging material is preferably coupled to the extending member 30 where the extending member and the first and second ends of the body portion are connected, and the decorative element 40 is releasably secured to the extending member. In this version, the top portion of the hanging material is preferably positioned within the hollow inner circular portion 102 formed by the body portion and between the decorative elements attached on each side of the body portion.

Figure 22:
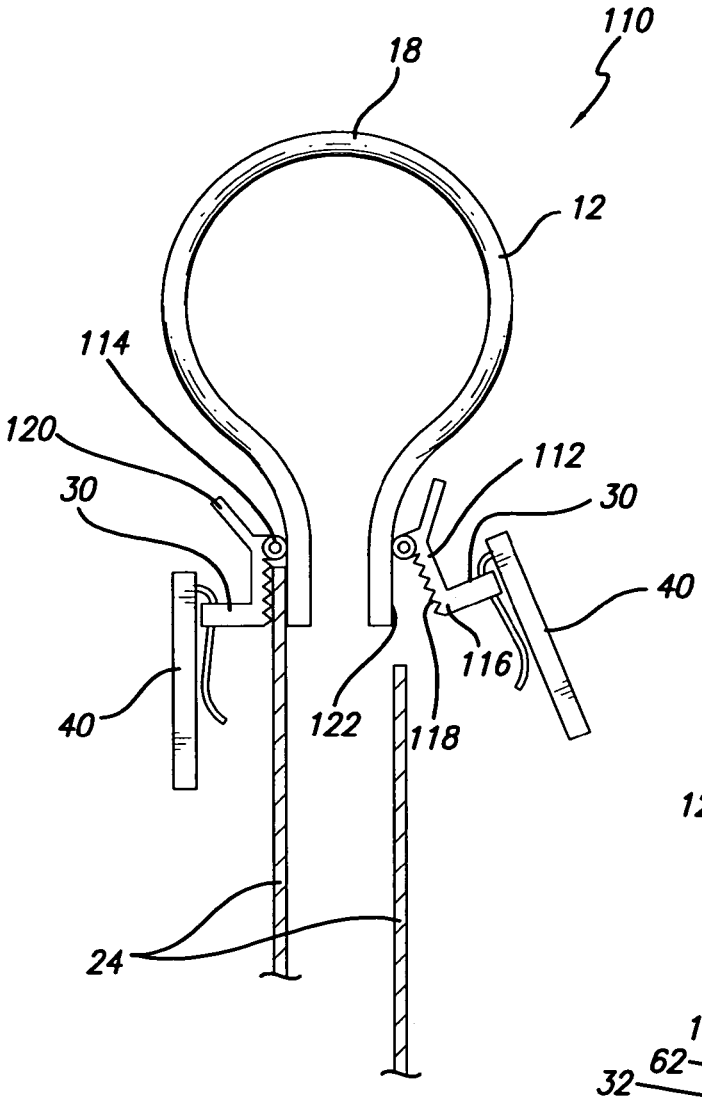
FIG. 22 is a front view of a fifth version of the hanger device of the invention; and, FIG. 23 is a front view of a sixth version of the hanger device of the invention.

FIG. 22 is a front view of a fifth version of the hanger device of the invention. In this version, a hanger device 110 comprises body portion 12 having a generally circular configuration, and in particular a lightbulb configuration, with an inside diameter sufficient in size for completely encircling a portion of the rod member when the hanger is coupled to the rod member and the rod member is suspended in a horizontal position. The hanger device of this version includes substantially all of the elements of the first version as discussed in detail above, that is, the body portion 12 having first end 14, second end 16 and top central portion 18, the extending member 30 extending from each of the first and second ends, such that one extending member is opposite the other extending member, and the decorative element 40 releasably attached or fixed to one or both of the opposed extending members. However, in this version, as shown in FIG. 22, each extending member 30 is in the form clamp member 112 having hinge portion 114, gripping surface 116 with teeth 118 and handle portion 120. When hanging material 24 is suspended from the hanger device 110, top portion 62 of the hanging material is coupled to the extending member 30 by clamping the top portion of the hanging material between the gripping surface 116 with teeth 118 and against exterior surface 122 of the body portion, and the decorative element 40 is releasably secured to the extending member. In this version, the top portion of the hanging material is preferably positioned between the body portion and the decorative element attached on each side of the body portion.

Figure 23:
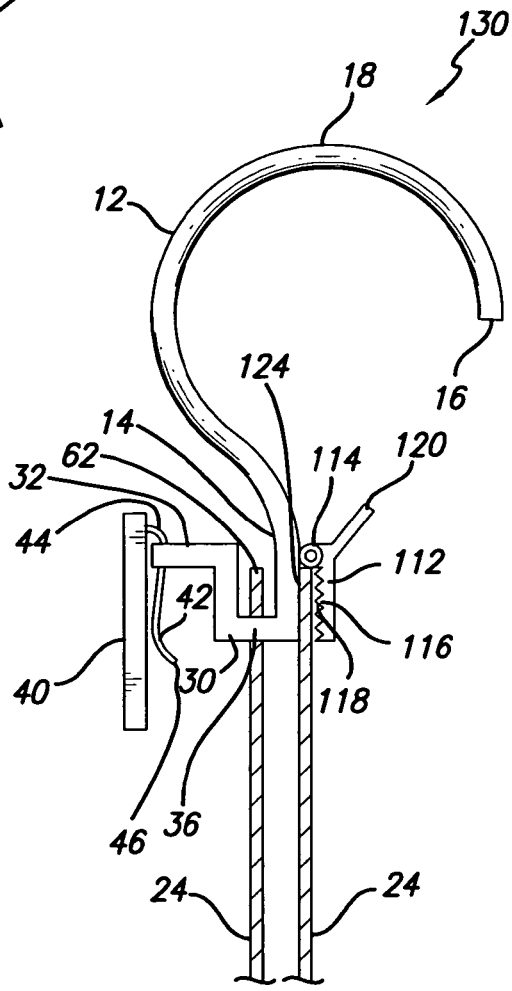

FIG. 23 is a front view of a sixth version of the hanger device of the invention. In this version, a hanger device 130 adapted to be mounted over an elongated rod member and adapted to suspend a hanging material is provided. The hanger device 130 comprises body portion 12 having a generally semi-circular configuration with an inside diameter sufficient in size for semi-encircling a portion of the rod member when the hanger is coupled to the rod member and the rod member is suspended in a horizontal position. The body portion 12 comprises first end 14, second end 16, and top central portion 18. The hanger device 130 further comprises a single extending member 30 having inner portion 36 connected to and extending from the first end 14 of the body portion 12, and further having outer portion 32 with an opening 34. The second end 16 of the body portion is a free end. In addition, a clamp member 112 is coupled to the interior of the first end 14 of the body portion 12. The clamp member 112 has hinge portion 114, gripping surface 116 with teeth 118, and handle portion 120. The clamp member 112 is adapted to suspend an additional hanging material 24 between an interior surface 124 of the first end of the body portion and the gripping surface with teeth of the clamp member. The hanger device 130 further comprises decorative element 40 having connector portion 42 with top end 44 and bottom end 46 and having cover portion 48 with inner surface 50 and outer surface 52, wherein the bottom end of the connector portion is adapted for insertion into the opening of the extending member such that the decorative element may be releasably secured to the extending member. The top end of the connector portion is attached to the inner surface of the cover portion. A first hanging material may be suspended from the hanger device 130 wherein a top portion 62 of the hanging material is coupled to the extending member 30. A second hanging material may be suspended from the hanger device 130 by clamping the top portion of the hanging material between the gripping surface 116 with teeth 118 and against interior surface 124 of the body portion. In this version, the first end of the body portion is between the top portions of each of the suspended hanging materials.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the invention.

Although the invention has been described with reference to certain preferred versions thereof, other versions of the invention are possible. In compliance with the statute, the invention described herein has been described in language more or less specific as to structural features. It should be understood, however, that the invention is not limited to the embodiments described herein or to specific features shown, since the means and construction shown, is comprised only of the preferred embodiments for putting the invention into effect. It is also understood that the phraseology and terminology employed herein are for the purpose of description and should not be regarded as limiting.

What is claimed is:

1. A hanger device adapted to be mounted over an elongated rod member and adapted to suspend a plurality of hanging materials, the hanger device comprising:

a body portion having a generally circular configuration with an inside diameter sufficient in size for encircling a portion of the rod member when the hanger is coupled to the rod member and the rod member is suspended in a horizontal position, the body portion having a first end, a second end, and a top central portion;

an extending member connected to and extending from each of the first and second ends of the body portion, wherein each extending member has an outer portion with an opening, and further wherein each extending member is opposite the other extending member and extends away from the other extending member, and wherein the opposed extending members comprise a configuration selected from the group comprising hooks, clamps, and clips; and, a decorative element having a connector portion with a top end and a bottom end and having a cover portion with an inner surface and an outer surface, wherein the connector portion is connected to the extending member by passing through the opening, such that at least one decorative element is releasably secured to a respective extending member, and wherein the top end of the connector portion is attached to the inner surface of the cover portion, and further wherein when the plurality of hanging materials are suspended from the hanger device, a top portion of the hanging materials is coupled to each opposed extending member.

2. The hanger device of claim 1 wherein the body portion includes a plurality of ball bearings coupled onto the body portion, and wherein one or more of the ball bearings can move laterally from the first end of the body portion toward the second end of the body portion to provide a balancing counterweight to the plurality of hanging materials.

3. The hanger device of claim 1 wherein the connector portion comprises a configuration selected from the group comprising a hook, clip, screw, and clamp.

4. A hanger device adapted to be mounted over an elongated rod member and adapted to suspend a plurality of hanging materials, the hanger device comprising:

a body portion having a generally circular configuration with an inside diameter sufficient in size for encircling a portion of the rod member when the hanger is coupled to the rod member and the rod member is suspended in a horizontal position, the body portion having a first end, a second end, and a top central portion;

an extending member connected to and extending from each of the first and second ends of the body portion, wherein each extending member has an outer portion with an opening, and further wherein each extending member is opposite the other extending member and extends away from the other extending member; and, a decorative element having a connector portion with a top end and a bottom end and having a cover portion with an inner surface and an outer surface, wherein the connector portion is connected to the extending member by passing through the opening, such that at least one decorative element is nonmovable and fixedly attached to a respective extending member, and wherein the top end of the connector portion is attached to the inner surface of the cover portion, and further wherein a top portion of the plurality of hanging materials is coupled to each opposed extending member.

5. The hanger device of claim 4 wherein the cover portion of the decorative element further includes a removable front surface such that the front surface is capable of having a plurality of interchangeable decorative shapes.

6. The hanger device of claim 4 wherein the body portion includes a plurality of ball bearings coupled onto the body portion, and wherein one or more of the ball bearings can move laterally from the first end of the body portion toward the second end of the body portion to provide a balancing counterweight to the plurality of hanging materials.

7. The hanger device of claim 4 wherein the opposed extending members comprise a configuration selected from the group comprising hooks, clamps, and clips.

8. A hanger device adapted to be mounted over an elongated rod member and adapted to suspend at least a first and a second hanging material, the hanger device comprising:

a body portion having a generally semi-circular configuration, with an inside diameter sufficient in size for semi-encircling a portion of the rod member when the hanger is coupled to the rod member and the rod member is suspended in a horizontal position, the body portion having a first end, a second end, and a top central portion;

an extending member connected to and extending from the first end of the body portion, wherein the extending member has an outer portion;

a clamp member coupled to the first end of the body portion and adapted to suspend the at least first hanging material between the first end of the body portion and a gripping surface of the clamp member; and, only one decorative element having a connector portion with a top end and a bottom end and having a cover portion with an inner surface and an outer surface, wherein the connector portion is connected to the extending member, such that the decorative element is releasably secured to the extending member, and wherein the top end of the connector portion is attached to the inner surface of the cover portion, and further wherein when the at least second hanging material is suspended from the hanger device, a top portion of the at least second hanging material is coupled to the extending member.

9. The hanger device of claim 8 wherein the body portion includes a plurality of ball bearings coupled onto the body portion, and wherein one or more of the ball bearings can move laterally from the first end of the body portion toward the second end of the body portion to provide a balancing counterweight to the at least first and second hanging material.

10. The hanger device of claim 8 wherein the extending member comprises a configuration selected from the group comprising hooks, clamps, clips, and snaps.

11. The hanger device of claim 8 wherein the connector portion comprises a configuration selected from the group comprising a hook, snap, clip, screw, clamp, and, twist lock.

12. A hanger device adapted to be mounted over an elongated rod member and adapted to suspend at least a first and a second hanging material, the hanger device comprising:

a body portion having a generally semi-circular configuration with an inside diameter sufficient in size for semi-encircling a portion of the rod member when the hanger is coupled to the rod member and the rod member is suspended in a horizontal position, the body portion having a first end, a second end, and a top portion;

an extending member connected to and extending from the first end of the body portion, wherein the extending member has an outer portion;

a clamp member coupled to the first end of the body portion and adapted to suspend the at least first hanging material between the first end of the body portion and a gripping surface of the clamp member; and, only one decorative element having a connector portion with a top end and a bottom end and having a cover portion with an inner surface and an outer surface, wherein the connector portion is connected to the extending member, such that the decorative element is nonmovable and fixedly attached to the extending member, and wherein the top end of the connector portion is attached to the inner surface of the cover portion, and further wherein when the at least second hanging material is suspended from the hanger device, a top portion of the at least second hanging material is coupled to the extending member.

13. The hanger device of claim 12 wherein the body portion includes a plurality of ball bearings coupled onto the body portion, and wherein one or more of the ball bearings can move laterally from the first end of the body portion toward the second end of the body portion to provide a balancing counterweight to the at least first and second hanging material.

14. The hanger device of claim 12 wherein the extending member comprises a configuration selected from the group comprising hooks, clamps, clips, and snaps.

15. The hanger device of claim 12 wherein the cover portion of the decorative element further includes a removable front surface such that the front surface is capable of having a plurality of interchangeable decorative shapes.

* * * * *